US005118186A

United States Patent [19]

Schrätzenstaller et al.

[11] Patent Number: 5,118,186

[45] Date of Patent: Jun. 2, 1992

[54] METHOD AND APPARATUS FOR ADJUSTING THE SIGHTING DEVICE IN WEAPON SYSTEMS

[75] Inventors: Josef Schrätzenstaller, Munich; Otto Ambrosius; Martin Hofmann, both of Solms; Heinz-Günther Franz, Hamburg; Horst Laucht, Bruckmühl; Robert Rieger, Ostermünchen; Reinhard Seiferth, Bruckmühl, all of Fed. Rep. of Germany

[73] Assignee: Messerschmitt-Bölkow-Blohm GmbH, Fed. Rep. of Germany

[21] Appl. No.: 652,663

[22] Filed: Feb. 8, 1991

[30] Foreign Application Priority Data

Feb. 9, 1990 [DE] Fed. Rep. of Germany ..... 4003932

[51] Int. Cl.[5] ..... G01B 11/27

[52] U.S. Cl. ..... 356/153

[58] Field of Search ..... 356/138, 152, 153, 251, 356/252

[56] References Cited

U.S. PATENT DOCUMENTS

| | | | |
|---|---|---|---|
| 3,464,770 | 9/1969 | Schmidt | 356/252 |
| 4,213,700 | 7/1980 | Leblanc | 356/252 |
| 4,422,758 | 12/1983 | Godfrey et al. | 356/138 |

FOREIGN PATENT DOCUMENTS

| | | |
|---|---|---|
| 3603521 | 6/1988 | Fed. Rep. of Germany . |
| 3605074 | 7/1988 | Fed. Rep. of Germany . |

*Primary Examiner*—F. L. Evans

*Attorney, Agent, or Firm*—Evenson, Wands, Edwards, Lenahan & McKeown

[57] ABSTRACT

A method and apparatus for adjusting an aiming telescope and a laser range finder with a weapon system which is equipped with a weapon computer, a data memory and a computer-controlled graticule adjusting device. Laser beams are fired consecutively by a collimation line testing device and by the laser range finder, into a collimator. A reference reticle or an aiming graticule of the aiming telescope are aligned with the laser beam images in the collimator, and the aligned position is stored in the data memory.

9 Claims, 3 Drawing Sheets

METHOD AND APPARATUS FOR ADJUSTING THE SIGHTING DEVICE IN WEAPON SYSTEMS

BACKGROUND AND SUMMARY OF THE INVENTION

The invention relates to a method for adjusting an aiming telescope and a laser range finder for a weapon system.

Many kinds of adjusting methods are known to the art, including several developed by the applicant. One such method, utilizing a computer-assisted sighting device, is disclosed, for example, in German Patent Document DE-PS 36 03 521, and another aiming method, for use with sighting devices of unguided weapons, is disclosed in German Patent Document DE-PS 36 05 074. These devices have been successful in practice, but can be used only for a limited class of weapon systems.

One technique that is utilized by the prior art is to connect a laser range finder with the weapon and the aiming telescope by means of an adjustable flange, and to adjust the laser range finder with respect to the axis of the weapon and the aiming telescope by means of a testing collimator. A similar technique which has also been used is to rigidly connect the laser range finder with the weapon and the aiming telescope, and adjust at the laser range finder the optical axes of the optical transmitter and receiver individually to the axis of the weapon and the aiming telescope.

The disadvantage of the first method is that it requires a mechanically expensive, shock-sensitive 2-axes adjusting flange; the disadvantage of the second method is the necessity for intervention in the hermetically sealed laser range finder and an expensive adjustment of two optical ray beams in two directions respectively. In addition, the target graticule of the aiming telescope either must not be changed, or else it must always be restored to its original position with each laser firing.

It is an object of the present invention to provide a method for adjusting a sighting device for a weapon system of the generic type described above, in which:

- no mechanical adjustment of flanges or similar devices is required between the weapon, the aiming telescope and the laser range finder;
- a manufacturing tolerance with respect to the fastening flanges of several milliradians is sufficient;
- adjustment is performed by motor-driven, computer-controlled graticule plates in the aiming telescope;
- the graticule plate positions for the zero position, the laser measurement, the emergency target graticule, and others, are permanently stored in the computer;
- the stored graticule positions can easily be changed and corrected, when the adjustment is tested by a suitable testing collimator.

Other objects, advantages and novel features of the present invention will become apparent from the following detailed description of the invention when considered in conjunction with the accompanying drawings.

DETAILED DESCRIPTION OF THE DRAWINGS

Figure 1A:
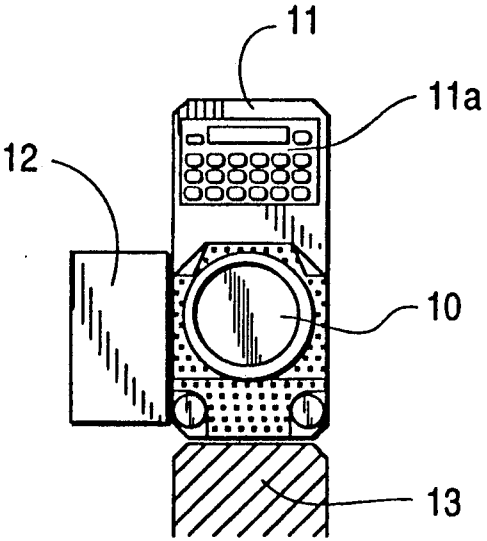
FIG. 1*a* is a front view of the device according to FIG. 1.
Figure 1:
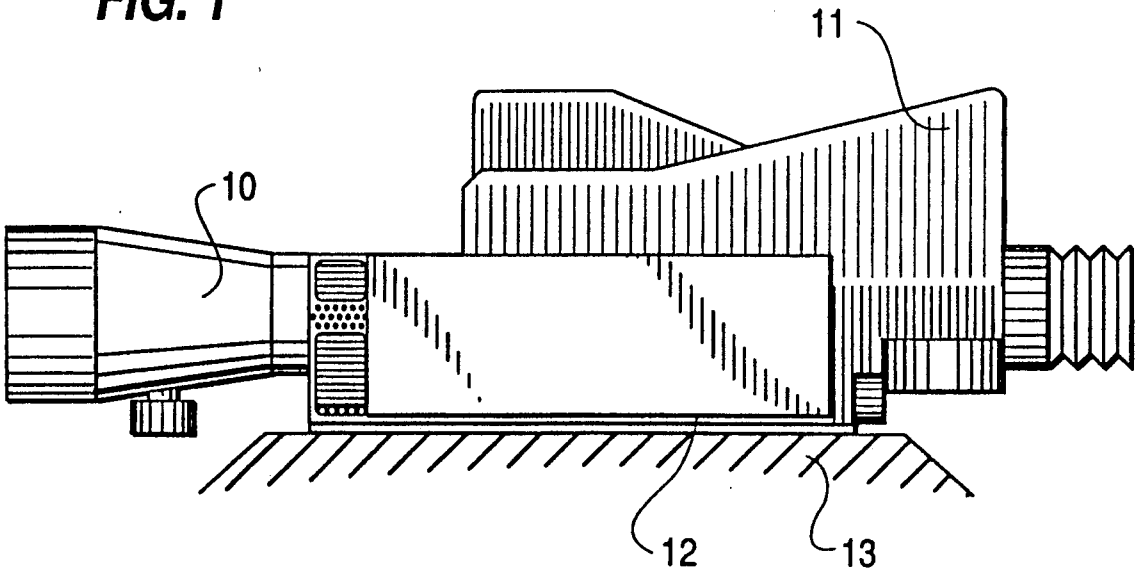
FIG. 1 is a lateral view of a weapon system equipped with an aiming telescope and a laser range finder.

FIGS. 1 and 1*a* illustrate an aiming telescope 10 which is equipped with a computer 11 having a keyboard 11*a*. The data storage capability of the computer and the graticule adjustment which it controls, are used to adjust the aiming telescope 10 with the laser range finder LEM 12, which is mechanically connected with it. The LEM 12 is adjusted in the factory and is mechanically connected with the aiming telescope 10 by way of a fastening flange in a conventional manner (not shown) such that the tolerance of the flange to the lens system amounts to approximately 1 mrad; this connection cannot be adjusted. When the adjustment range of the aiming telescope is large enough, correspondingly higher tolerance values may be accepted.

In the following, two alternative modes of practicing the present invention are described, which have in common that the aiming telescope 10 is mechanically connected with the weapon system 13 within a tolerance range of, for example, ±2 mrad.

Figure 2:
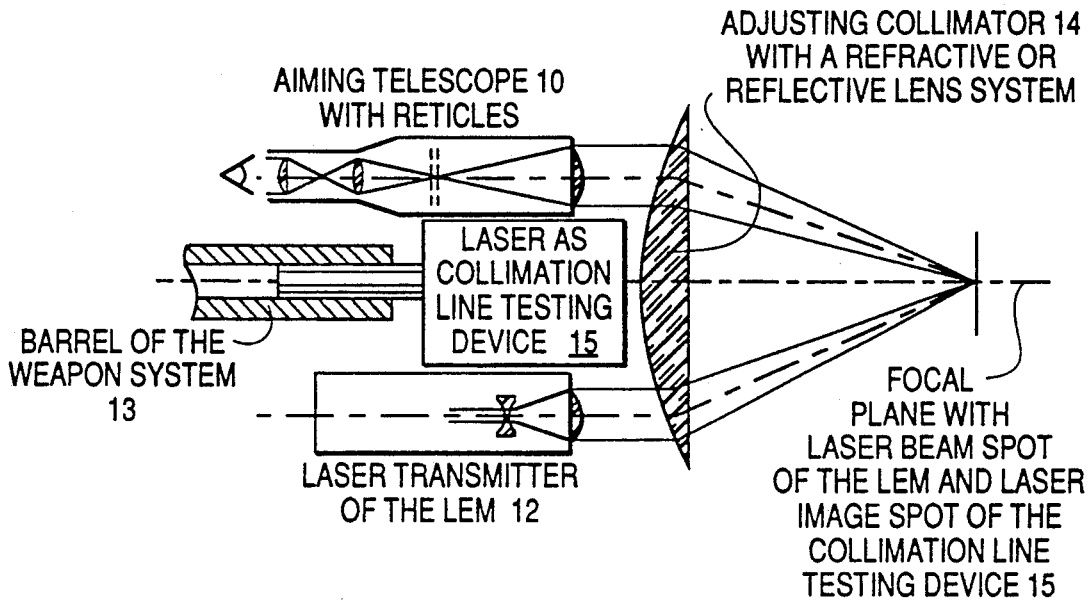
FIG. 2 is a schematic depiction of the optically important parts of the weapon sight, and the auxiliary optical means needed for the adjustment thereof, including a collimator and a collimation line testing device.

In the first mode, the reference reticle 16 (FIG. 3) is first mechanically adjusted and locked by means of a collimator 14 and a collimation line testing device 15. Collimator 14 is an auxiliary instrument commonly used for the alignment of different optical axes. It consists of a focusing lens system as shown in FIG. 2, but may also utilize a focusing reflective optic. In the focal plane there is in this case a special paper or film, into which the laser of the laser range finder 12 burns a hole, when it is fired. One may also use a special film, on which the focused laser beam generates a permanent mark. The hole or mark can be observed through the aiming telescope 10 containing the two plates with reference reticle 16 and main graticule 18.

The collimation line testing device 15 is e.g., a HeNe laser fixed on a rod, which fits exactly into the barrel of a rifle or a gun (FIG. 2). It is produced in such a way that the axis of the rod (and hence the gun barrel) is exactly in line with the laser beam, and therefore give a precise visible reference line and reference point of the uncorrected shooting direction of the weapon. The reference point is produced in the focal plane of the collimator 14, and is thus visible through the aiming telescope 10, in the form of a red laser spot.

The reference reticle 16 is mechanically adjusted in two directions and locked onto this laser spot, so that the position of reference reticle coincides precisely with the pointing direction of the weapon axis. Thus, if one looks through the aiming telescope 10 and directs the adjustment mark onto a far away target, the weapon axis is then pointing exactly onto the same target. In order to actually hit the target, of course, it is necessary (due to the curved trajectory of the projectile) to elevate the axis of the weapon as a function of target distance. In the weapon sight according to the invention an emergency target graticule is provided in order to permit operation of the weapon when adjustment of the sight is impossible, due for example, to a power failure. The fixed spatial relationship between the reference reticle and the emergency target graticule in the aiming telescope is such that when the former is aligned with the weapon axis, the latter is automatically in the correct position for an emergency shot at a distance of 600 meters. The value of 600 meters is, of course, simply by way of example. Any other suitable distance could be used.

Both the reference reticle 16 and the main graticule 18 are superpositioned in the focal plane of the aiming telescope 10. The reference reticle 16 also contains the zero marks for motor-controlled displacement of a graticule plate 18.

Figure 3:
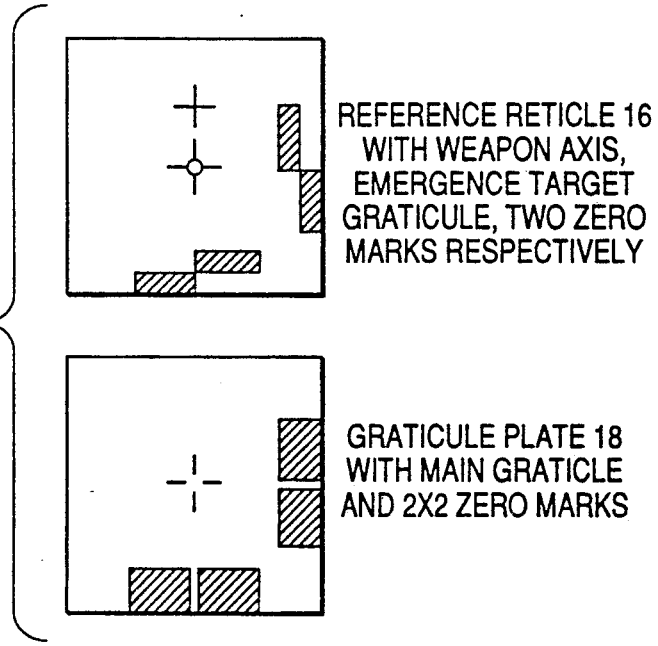
FIG. 3 is a schematic depiction of the reference reticle with the zero marks, the adjusting mark for the weapon axis and the emergency target graticule.

Referring to FIG. 2, still in the first mode, after mechanical adjustment and locking of the reference reticle, a laser beam is fired by laser transmitter 12 into the collimator 14; and by means of the computer 11 and the keyboard 11*a*, the main graticule 18 is moved onto the image of the laser beaming spot by two stepping motors. This graticule position (relative to its zero-position) is now stored in the computer 11 as a target graticule position for range finding. The "zero-position" of the main graticule 18 relative to the reference reticle 16 in the horizontal and vertical direction in the field-of-view, is determined by e.g. 4 light emitting diodes and 4 photo detectors together with the zero-marks on the reference reticle and the main graticule (FIG. 3). When the weapon sight is switched on, the stepping motors, controlled by the computer, move the graticule 18 until the zero-marks on the graticule 18 coincide with those on the reference reticle 16, as determined by the light emitting diodes and photodetectors in a known manner. The zero-position is transferred to the computer which also controls the stepper motors that move the main graticule in horizontal and vertical direction within the field-of-view. The computer has a memory, where it stores the momentary position of the main graticule relative to its zero-position in the form of the number of steps of the stepper-motors. By counting the steps of the stepping motors, the computer can position the main graticule 18 in any position which is calculated by the computer. Further adjustment of the weapon system is no longer required. Moreover, since the emergency target graticule is to be used when the computer fails, it is adjusted once with respect to the weapon in a fixed manner with respect to the device, and is not subject to the control by the computer.

Figure 4:
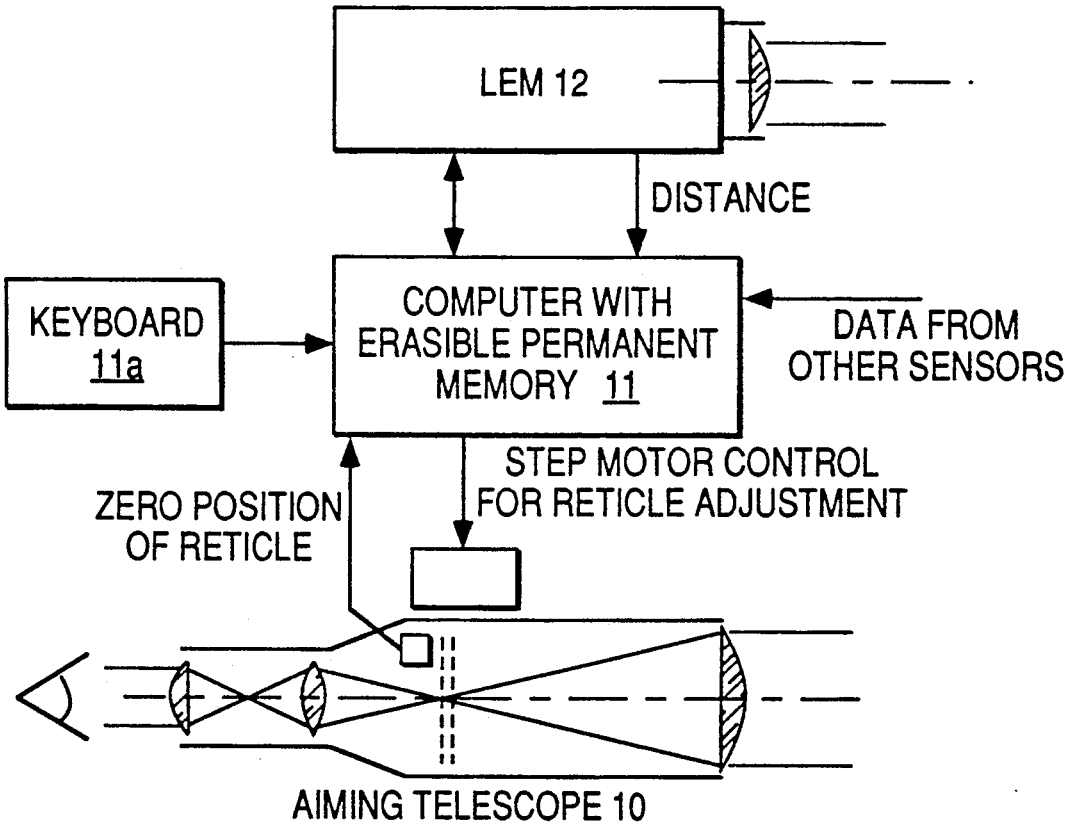
FIG. 4 is a schematic depiction of a complete aiming device which shows the connection with the computer and the data flow within the system for the computer-controlled displacement of the main graticule on the laser beaming spot.

In the second mode, the reference reticle is not needed. The zero-marks of the reference reticle become part of the device consisting of light emitting diodes and detectors and are together fixed in the aiming telescope 10. Such a device, as described above is a common means to determine a zero position of another device like the main graticule 18. In the second mode, this zero position is arbitrary, but constant for every aiming system as long as the system is maintained in a fixed spatial relationship to the weapon. In the beginning of the alignment procedure, the motor driven main graticule 18 is moved by the computer until the graticule crosses the zero position, causing a signal from the position sensors to computer as indicated in FIG. 4. Thereafter, the computer determines the position of the graticule by counting the steps of the two step motors.

The axis of the weapon system 13 is then determined by means of the collimator 14 and the collimation line testing device 15, which fires a laser beam into the collimator in the same manner as described in the first mode, above. The computer and the keyboard are then used to move the main graticule of the graticule plate 18 onto the image created by the collimation line testing device 15 in the collimator 14. This graticule position (relative to its zero position) is stored in the computer 11.

Next, the laser range finder LEM12 fires a laser beam into the collimator 14. Again, the computer 11 and the keyboard 11*a* are used to move the main graticule of the graticule plate 18 onto the image of the laser beaming spot in the focal plane of collimator 14, and this graticule position is stored in the computer 11 as the target graticule position for range finding. The position of the graticule belonging to the axis of the laser range finder 12 is needed when performing range finding in the field against a target. This range or distance is used by the computer together with other information from the computer memory, from additional sensors and from the keyboard as indicated in FIG. 4 to calculate the necessary position of the graticule 18 needed for shooting on a target. By steering the stepping motors, the computer moves the graticule into this position. Looking through the aiming telescope 10 the gunner simply puts the cross hair onto the image of the target by moving the weapon.

When the system is switched off, the graticule is automatically moved to the 600 m range position in a known manner, which condition is indicated visually or acoustically to the person firing the weapon. The status of emergency can be indicated to the gunner for instance by the extinguishing of a pilot light in the aiming telescope 10 or by an optical signal, which is driven electromechanically. Such signals are common in switchboards. Additionally, the gunner can be warned by an acoustical signal at the moment of power failure if wanted.

By means of the above-described measures in the second mode, the need for mechanical adjustment of the reference reticle plate 16 is eliminated. This plate is firmly integrated in the aiming telescope 10 and establishes an arbitrary point as the zero point for the displacement of the graticule plate 18; the steps that were moved in this case in the x- and y-direction are stored as coordinates and are used as the reference point for the system control before the firing.

It should also be noted that the zero marks of the reference reticle 16 are not adjusted with respect to the weapon. The emergency reticle on the reference reticle and the zero mark for the weapon are thus unnecessary, because in this mode the main target graticule is also the emergency target graticule.

In a further embodiment of the invention, visual displays may be presented to the person firing the weapon in the aiming telescope, identifying the operational sequence of steps and the state of readiness of the system. These steps may be defined as follows:

a) Switch on system—initializes the computer and so indicates;

b) "laser ready"—causes the graticule plate 18 move into the position for range finding;

c) measuring operation;

d) measuring result—the reticle moves into the "fire" position;

d) firing.

After the operations through step d), a return may take place to operation b), for example, by pressing a key, and the cycle may be repeated.

The first mode of practicing the invention as described above has an advantage relative to the second mode, in that the emergency target graticule is adjusted in a fixed manner. Thus, in the case of a system breakdown, such as a power failure, the weapon is immediately available for emergency operation without initializing the laser range finder and the computer. The second embodiment, on the other hand, has the advantage that no mechanical displacement and locking of a reticle plate is required; the adjusting takes place only by means of an adjusting collimator and a computer with an input keyboard.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. Method for adjusting an aiming telescope of a weapon system, said aiming telescope being fixedly mounted to and aligned with said weapon system within a first predetermined tolerance, and having a laser range finder fixedly mounted thereon and aligned therewith within a second predetermined tolerance, said aiming telescope having a main graticule plate with a main graticule thereon, a reference reticle, and a graticule adjusting device controlled by a keyboard and a computer of said weapon system, said method comprising the steps of:

mechanically adjusting the position of said reference reticle to align with an axis of the weapon system, by means of a collimator and collimation line testing device;

locking said reference reticle in said aligned position;

firing a laser beam from said laser range finder into said collimator;

moving said main graticule by means of said keyboard, computer and graticule adjusting device, into a position of alignment with an image of said laser beam in said collimator; and storing said position of said main graticule in said computer as the target graticule position.

2. Method according to claim 1, wherein said step of mechanically adjusting the position of said reference reticle further comprises the steps of:

firing a laser beam from said collimation line testing device into said collimator; and mechanically moving said reference reticle until cross hairs thereof are aligned with an image of said laser beam from collimation line testing device in said collimator.

3. Method according to claim 1, wherein said first predetermined tolerance is ±2 mrad, and said second predetermined tolerance is ±2 mrad.

4. Apparatus for adjusting the aiming a weapon system comprising:

an aiming telescope and a laser range finder, both of which are fixedly mounted to, and aligned with an axis of, said weapon system within predetermined tolerances, said aiming telescope having a main graticule plate with a main graticule thereon, and a reference reticle;

a collimation line testing device adapted to be aligned precisely with said axis of said weapon system and adapted to fire a first laser beam into a collimator;

means for mechanically moving said reference reticle to a position in which cross hairs thereof are aligned with an image generated in said collimator by said first laser beam, and for locking said reference reticle in said position;

means for causing said laser range finder to fire a second laser beam into said collimator;

a computer having a memory and a keyboard for entering commands therein;

means responsive to commands inputted to said computer for moving said main graticule plate to a position in which it aligns with an image generated in said collimator by said second laser beam; and means for storing said position of said main graticule in the memory of said computer.

5. Apparatus according to claim 4, wherein the reference reticle is provided with a zero mark for the motor-controlled displacement of the graticule plate 18, an adjusting mark for the weapon axis, and a 600 m emergency target graticule.

6. Method for adjusting an aiming telescope of a weapon system, said aiming telescope being fixedly mounted to and aligned with said weapon system within a first predetermined tolerance, and having a laser range finder fixedly mounted thereon and aligned therewith within a second predetermined tolerance, said aiming telescope having a main graticule plate with a main graticule thereon and a graticule adjusting device controlled by a keyboard and a computer of said weapon system, said method comprising the steps of:

firing a first laser beam from a collimation line testing device, precisely aligned with an axis of said weapon system, into a collimator;

moving said main graticule of the main graticule plate by means of said graticule adjusting device and said keyboard and computer into a first graticule position, in which it is aligned with an image generated by said first laser beam in said collimator;

storing said first graticule position in a memory of said computer;

firing a second laser beam from said laser range finder into said collimator;

moving said main graticule of said main graticule plate by means of said graticule adjusting device and said keyboard and computer into a second graticule position, in which it is aligned with an image generated by said second laser beam in said collimator; and storing said second graticule position in said memory of said computer.

7. Method according to claim 6, wherein said first predetermined tolerance is ±2 mrad and said second predetermined tolerance is ±2 mrad.

8. Method according to claim 6, wherein when power to said weapon system is interrupted, said main graticule is automatically moved into a 600 meter emergency target graticule position, which is indicated to an operator of said weapon system by one of: a visual display, and an acoustic warning.

9. Apparatus for aiming a weapon system comprising an aiming telescope and a laser range finder, both of which are fixedly mounted to and aligned with an axis of said weapon system, within predetermined tolerances, said aiming telescope having a main graticule plate with a main graticule thereon;

a computer having a memory and a keyboard for entering commands therein;

a collimation line testing device adapted to be aligned precisely with said axis of said weapon system, and adapted to fire a first laser beam into a collimator;

means responsive to commands inputted to said computer for moving said main graticule of said main graticule plate into a first graticule position in which it is aligned with an image generated by said first laser beam in said collimator;

means for storing said first graticule position in the memory of said computer;

means for causing said laser range finder to fire a second laser beam into said collimator;

means responsive to commands inputted to said computer for moving said main graticule of said main graticule plate to a second graticule position in which it is aligned with an image generated in said collimator by said second laser beam; and means for storing said second graticule position in the memory of said computer.

* * * * *